US005694734A

United States Patent [19]

Cercone et al.

[11] Patent Number: 5,694,734

[45] Date of Patent: Dec. 9, 1997

[54] CURING OF FILAMENT WOUND COLUMNS USING A RADIANT HEATER

[75] Inventors: Larry Cercone, Laramie, Wyo.; Nicholas J. White; Alexander Joseph Lapid, both of San Diego, Calif.

[73] Assignee: XXSYS Technologies, Inc., San Diego, Calif.

[21] Appl. No.: 576,584

[22] Filed: Dec. 18, 1995

Related U.S. Application Data

[63] Continuation-in-part of Ser. No. 284,155, Aug. 1, 1994, and a continuation-in-part of Ser. No. 486,023, Jun. 7, 1995.

[51] Int. Cl.[6] ..... E04B 1/16; E04G 23/02; F27B 17/00

[52] U.S. Cl. ..... 52/745.17; 52/741.3; 52/738.1; 52/737.5; 52/723.2; 156/71; 156/172; 156/431; 405/257; 432/184; 264/35; 264/258

[58] Field of Search ..... 52/515, 721.2, 52/721.4, 721.5, 723.1, 723.2, 737.4, 737.5, 738.1, 741.3, 745.17; 156/71, 94, 169, 172, 425, 428, 431, 432; 264/31, 35, 257, 258; 405/231, 256, 257; 432/184

[56] References Cited

U.S. PATENT DOCUMENTS

| | | | |
|---|---|---|---|
| 419,998 | 1/1890 | Anderson | 52/737.5 |
| 2,370,780 | 3/1945 | Crom . | |
| 2,520,402 | 8/1950 | Hirsh . | |
| 3,074,704 | 1/1963 | Ronay | 432/184 X |
| 3,255,976 | 6/1966 | Mede . | |
| 3,380,675 | 4/1968 | Baxter, Jr. et al. | 242/436 |
| 3,616,070 | 10/1971 | Lemelson . | |
| 3,822,167 | 7/1974 | Piola . | |
| 5,043,033 | 8/1991 | Fyfe | 52/721.4 X |
| 5,133,510 | 7/1992 | Davis et al. . | |
| 5,326,410 | 7/1994 | Boyles | 156/71 |
| 5,380,131 | 1/1995 | Crawford | 52/738.1 X |

*Primary Examiner*—Carl D. Friedman
*Assistant Examiner*—Kevin D. Wilkens
*Attorney, Agent, or Firm*—Gregory Garmong

[57] ABSTRACT

A material having fibers in a curable matrix is applied as a reinforcement to a vertical column. The matrix is cured by providing a reinforcement curing apparatus including a steel cylindrical housing split lengthwise into at least two sections, and a plurality of elongated radiant heaters mounted to an interior wall of the housing and oriented to direct their heat inwardly. The curing apparatus is assembled around the perimeter of the column having the reinforcement thereon and operated to heat and cure the reinforcement.

15 Claims, 11 Drawing Sheets

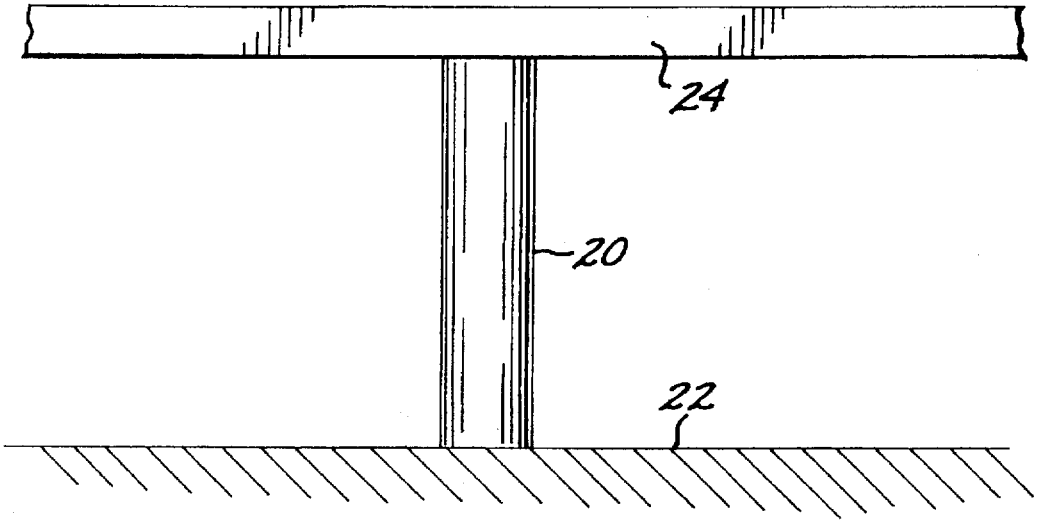
FIG. 1
FIG. 2
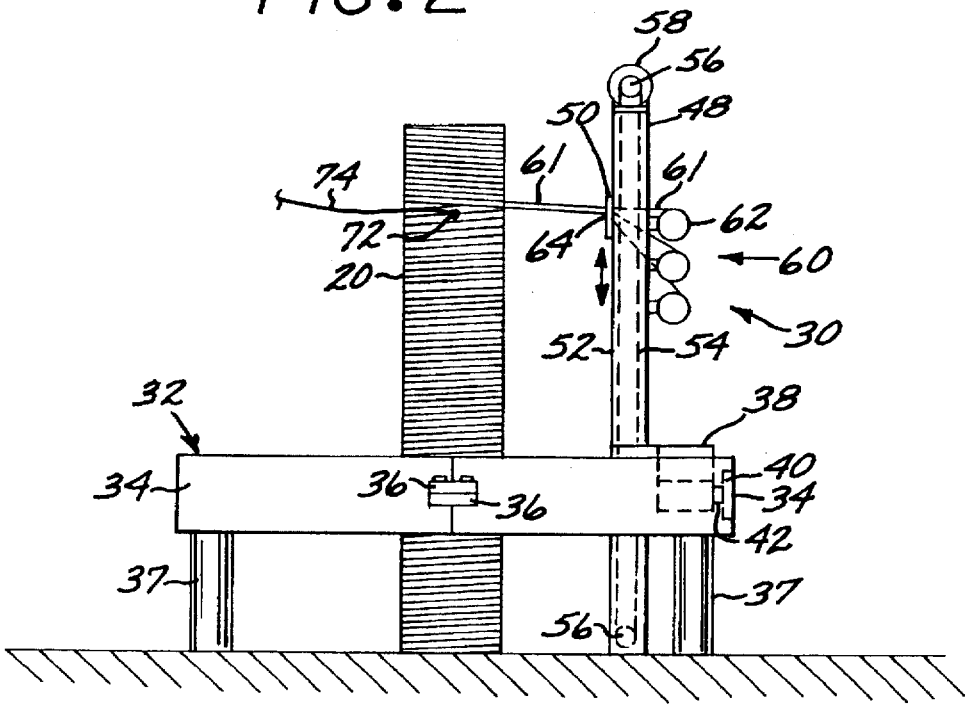

CURING OF FILAMENT WOUND COLUMNS USING A RADIANT HEATER

This application is a continuation-in-part of application Ser. No. 08/284,155, filed Aug. 1, 1994, status pending, for which priority is claimed; and is a continuation-in-part of application Ser. No. 08/486,023, filed Jun. 7, 1995, status pending, for which priority is claimed.

BACKGROUND OF THE INVENTION

This invention relates to the reinforcement of fixed vertical columns, and, more particularly, to the seismic reinforcement of bridge columns and the like.

Recent earthquakes in California and their resulting damage have emphasized the need for reducing the susceptibility of roadways to seismic disturbances. Such damage can occur in many ways, but one of the most dangerous and potentially most disruptive forms is the weakening and/or collapse of bridges.

Many bridges can be viewed as having a bridge decking supported by long, thin vertical columns. The California earthquakes have demonstrated that the support columns built prior to 1971 have insufficient transverse hoop reinforcement, and therefore may deform laterally, debond, or buckle under their end loadings. The support columns are usually constructed of concrete poured around a steel central structure. Concrete does not have significant ductility. The seismic activity, if of sufficiently high magnitude, can cause the concrete to crack and fall away, leaving the remainder of the column under increased load. The steel reinforcing structure can then fail in compression, or there may be shear or debond failures at joints and elsewhere in the column. Public agencies cannot prudently leave such structurally insufficient columns in place without taking corrective action.

Studies have determined that external strengthening of vertical support columns can improve their ability to withstand seismic damage. The external strengthening desirably provides an external reinforcement around the vertical column, so that the concrete is constrained against lateral failure even under severe loadings. Such strengthening can be performed either when the column is first built or as a retrofit of existing structures.

Several approaches have been considered for the external lateral strengthening of vertical support columns. In one, composite material reinforcements are added to the external surfaces of the columns. The composite material is formed of elongated fibers in a curable polymeric matrix. The composite material is applied to the column with the matrix in a state in which it is not fully cured and is subsequently cured to its final state.

A number of techniques have been proposed to cure the matrix of the composite material in place on the column. Curing is conducted according to the specified procedure for the selected polymeric material, but curing typically requires that the matrix be heated to a temperature of about 250° F. for a time of about 2–3 hours. Because the heating temperature during curing is moderate, heating blankets and hot-air blowers have been proposed to cure the composite material.

Heating blankets have the disadvantage that any one column is often not of a constant diameter from bottom to top, and successive columns to be treated are often different from each other in diameter and height. The heating blankets must therefore be applied in a custom fashion that is not conducive to the use of relatively untrained labor. Even when skilled workers are employed, errors can result from overlaps of adjacent blankets that cause hot spots or gaps that cause cold spots, either of which result in uneven curing and possibly damage to the overlapping heating blankets in the case of overlaps. The use of hot air blowers avoids some of these problems, but it has proved difficult to control hot air blowers to achieve a uniform heating of the reinforcement both circumferentially and vertically over the entire surface of the column, in part due to the chimney effect around the vertically oriented column.

The reinforcing of vertical stationary structural columns presents a difficult challenge for several reasons. The columns are typically massive in size, so that handwork or commonly available small-scale techniques simply are not practical. Curing apparatus cannot be slipped over the top of the column in the case of a retrofit. The column cannot be rotated or otherwise moved, so that reinforcing and curing techniques developed in the aerospace industry for manufacturing large tubular structures cannot be used.

There accordingly exists a need for an improved approach to the reinforcing of long, substantially vertical columns such as found in highway overpass construction and some buildings, using a curable composite material. The approach should be readily implemented in practice, yet produce an overlying structure without joints which are subject to premature failure during seismic activity. The present invention fulfills this need, and further provides related advantages.

SUMMARY OF THE INVENTION

The present invention provides a method and apparatus for preparing a reinforced column. The approach produces a well-controlled, precisely cured reinforcement. A single size of curing apparatus is used on a wide variety of effective diameters of uniform or nonuniform columns. The curing apparatus may be provided in a series of longitudinal sections to permit use with different height columns.

In accordance with the invention, a method for preparing a reinforced column comprises the steps of providing a vertically extending column having a column effective diameter and positioning a reinforcement to contact a perimeter of the column, the reinforcement comprising elongated fibers in a curable matrix. The method further includes providing a reinforcement curing apparatus comprising a steel cylindrical housing split lengthwise into at least two sections, and a plurality of elongated radiant heaters mounted to an interior wall of the housing and oriented to direct their heat inwardly. Preferably, the radiant heaters use electrical resistive heating elements mounted to the interior wall of the housing in a circumferentially spaced-apart fashion, and a plurality of heat reflectors disposed between the radiant heaters. The curing apparatus is assembled around the perimeter of the column having the reinforcement thereon, and the radiant heaters are operated to heat and cure the reinforcement.

The radiant heating approach is particularly useful because a single apparatus is suitable for curing reinforcement on different columns of different effective diameters and varying diameters along the length of a single column. It is also useful for curing reinforcement on columns of different lengths, as the curing apparatus is easily made in a modular form wherein split cylindrical sections are positioned in an end-to-end fashion. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is an elevational view of a large, stationary, vertical support column for a bridge;

FIG. 2 is an elevational view from a first direction of an embodiment of the apparatus of the invention in place for wrapping reinforcement around a column;

DETAILED DESCRIPTION OF THE PREFERRED EMBODIMENT

FIG. 1 depicts a stationary vertical column 20 that rests upon footings placed into the ground 22. The upper end of the vertical column 20 supports part of a bridge decking 24. The present invention is to be used to retrofit the vertical column 20 with a plurality of layers of spirally wound reinforcing material. The vertical column 20 is formed of concrete cast over a central steel structure (not visible). The vertical column 20 may be of different sizes, depending upon the application. In a typical case, the vertical column 20 is about 1 ½ to 8 feet in diameter and 8 to 80 feet in height.

Figure 3:
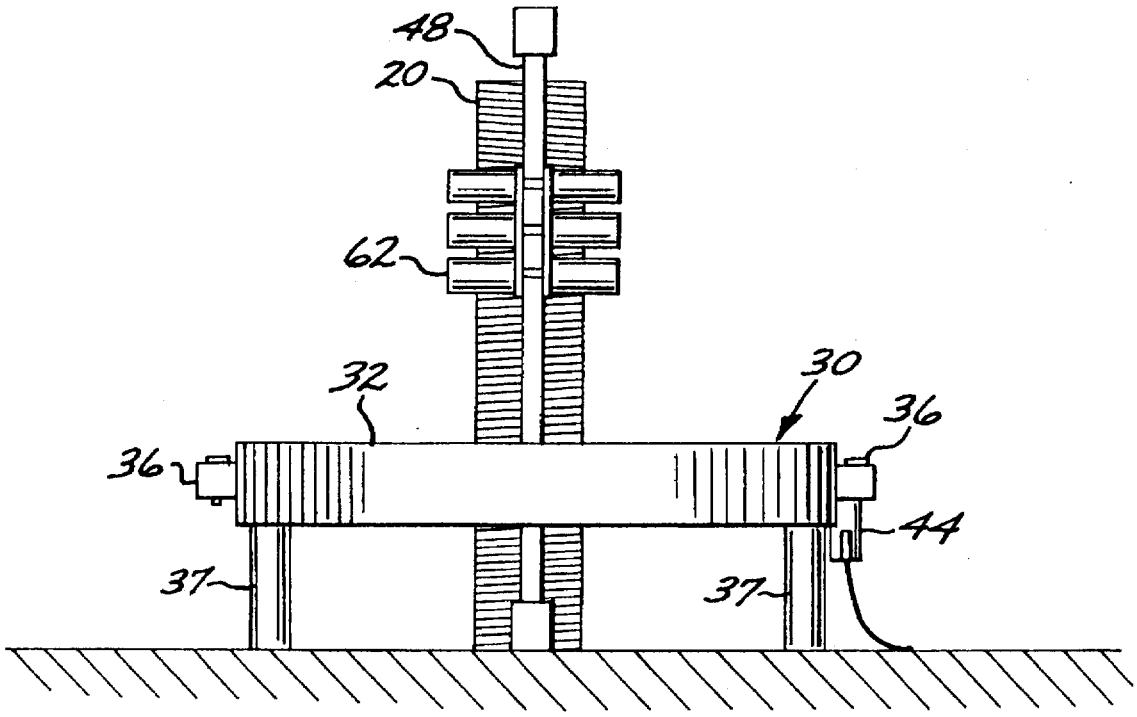
FIG. 3 is an elevational view of the apparatus of FIG. 2 from a second direction.
Figure 4:
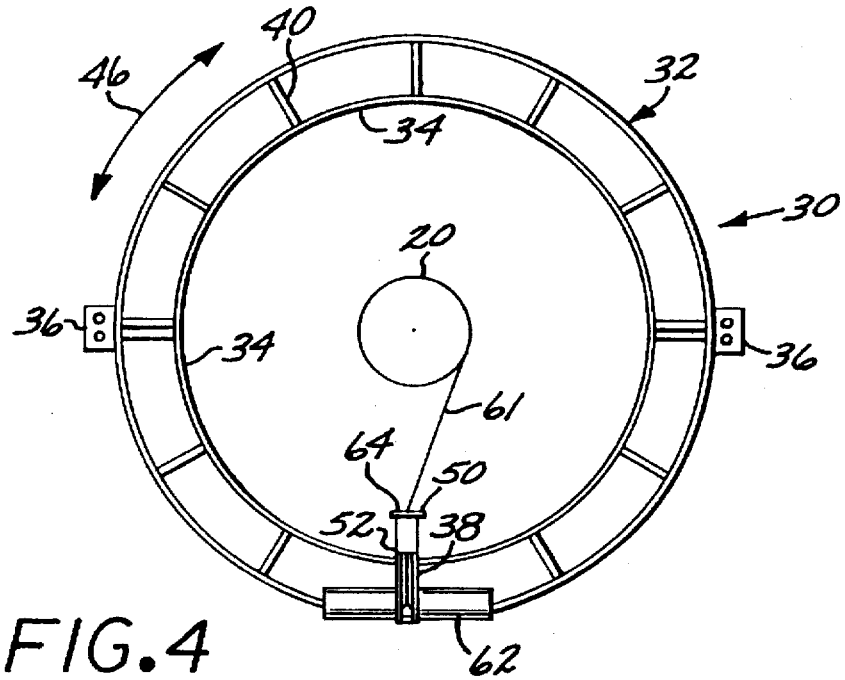
FIG. 4 is a plan view of the apparatus of FIG. 2.

FIGS. 2, 3, and 4 present three views of one form of a winding apparatus 30 for winding spirally wrapped layers of a reinforcing material onto the vertical column 20. The apparatus 30 includes a base 32 that is formed from two semicircular pieces 34 that can be assembled to form the annular base 32. The two pieces 34 are usually transported as separate pieces and then assembled around the vertical column 20 at the work site. Each of the pieces 34 has a flange 36 at its circumferentially opposite ends, and the pieces 34 are joined with bolts through the flanges 36. The base 32 is supported on legs 37 whose lengths may be adjusted by the operation of jacks in order to level the base.

A rotary carriage 38 is supported on the base 32. A first drive means is provided to drive the rotary carriage 38 in a circumferential direction around the base 32. Any operable drive means can be used. In the illustrated embodiment, the first drive means includes a first track 40 that extends around the lower surface of the base 32. The outwardly facing radial surface of the rotary carriage 38 includes a cog wheel 42, shown in phantom view in FIG. 2. The cog wheel 42 engages the first track 40. A first motor 44 controllably turns the cog wheel 42 to produce a rotary movement of the rotary carriage 38 in the circumferential direction 46, either in a clockwise or counterclockwise sense and at a speed which is selectable by the speed of the first motor 44.

A vertical mast 48 is mounted vertically to the rotary carriage 38. The vertical mast 48 is preferably mounted so that it lies inside the inner diameter of the annular base 32. The vertical mast 48 can extend as close to the ground and as high as necessary to permit reinforcement wrapping of all or a selected portion of the vertical column 20. The vertical mast 48 is movable around the entire circumference of the base 32 by the corresponding movement of the rotary carriage 38 in the manner previously described.

A vertical carriage 50 is supported on the vertical mast 48. A second drive means is provided to move the vertical carriage 50 either upwardly or downwardly along the vertical mast 48. Any operable drive means can be used. In the illustrated embodiment, the second drive means includes a second track 52 that extends along the side of the vertical mast 48 that faces inwardly toward the vertical column 20. The vertical carriage is engaged to the second track 52. A chain or belt 54 extends between two support wheels 56, one at the top of the vertical mast 48 and the other at the bottom of the vertical mast 48. A second motor 58 controllably turns one of the support wheels 56, the upper support wheel in the illustrated case, to controllably drive the vertical carriage 50 in the vertical direction, either upwardly or downwardly and at a speed which is selectable by the speed of the second motor 58. In one convenient mode of operation, the first motor 44 and the second motor 58 are operated with a fixed ratio of speeds, so as to maintain a selectable wrapping pitch to the reinforcing material as it is wrapped onto the column.

A supply 60 of a reinforcing material 61 is provided in the apparatus 30. Preferably, the supply 60 includes at least one rotatable spool 62 of the reinforcing material supported from the vertical mast 48 at a fixed vertical location. In a prototype apparatus 30 built by the inventors, six spools of reinforcing material are supported from the vertical mast 48, three on each side of the vertical mast 48.

The reinforcing material 61 is preferably tows of prepreg, curable composite material. Such tows are available commercially from various manufacturers. Briefly, the tows are bundles of reinforcing fibers impregnated with a curable polymeric matrix material. A most preferred material is tows of carbon fibers with a heat-curable epoxy matrix material impregnated therein. Other fiber types such as glass or aramid fibers, for example, may be used. Other heat curable matrix materials such as phenolics, vinyl esters, and polyesters, for example, may also be used. One advantage of the present approach is that it permits great flexibility in the selection of the reinforcing material.

A guide structure 64 is supported on the vertical carriage 50. The guide structure 64 functions to direct the reinforcing material from the supply 60 onto the vertical column 20 in a generally tangential orientation as shown in FIG. 4. The guide structure 64 moves vertically according to the movement of the vertical carriage 50 and circumferentially according to the movement of the rotary carriage 38.

Figure 5A:
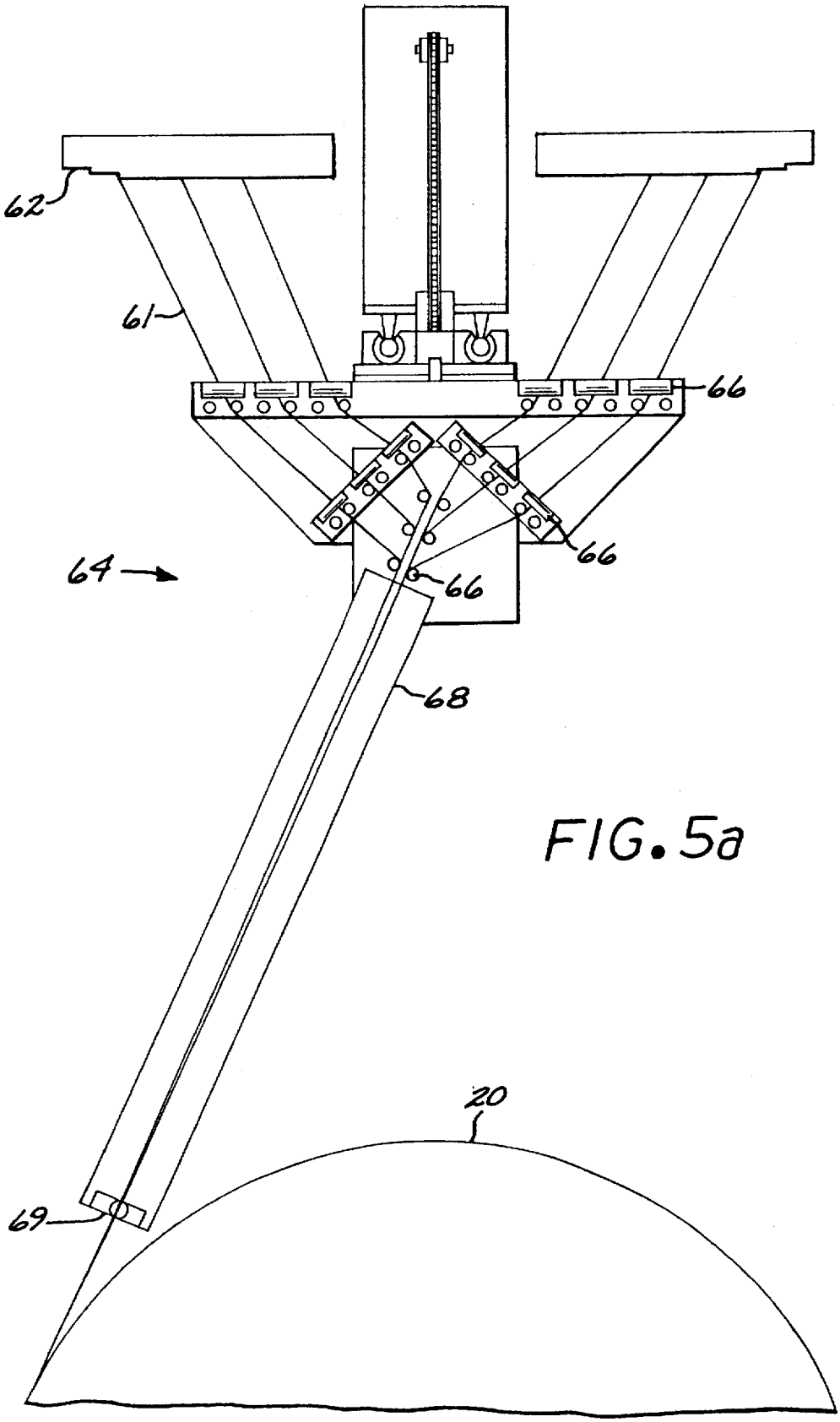
FIG. 5*a* is a plan view of the reinforcement guide arrangement used in the apparatus.
Figure 5B:
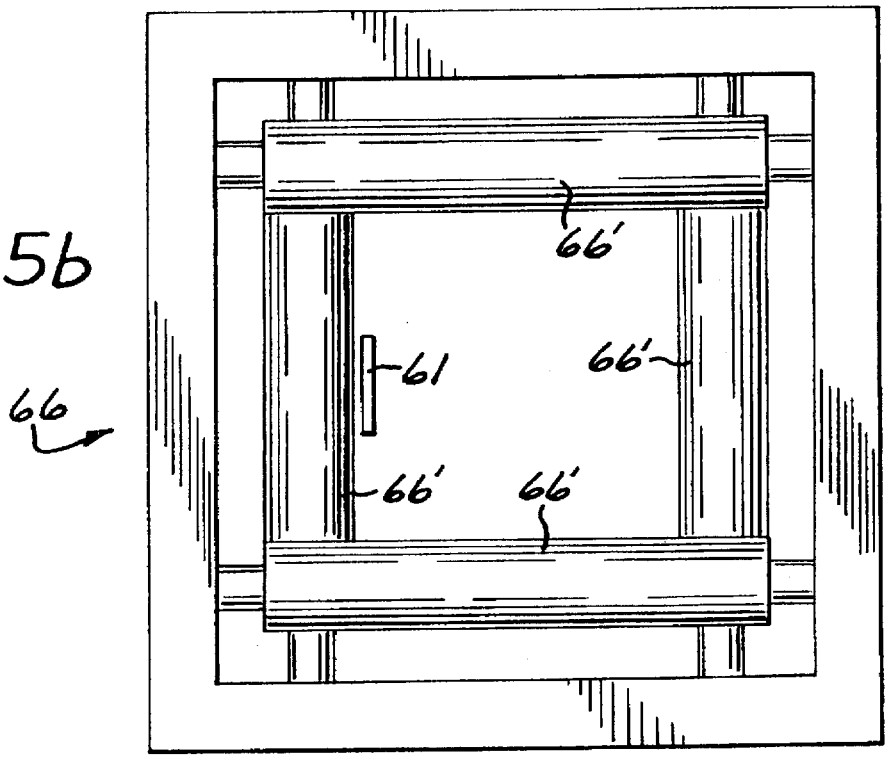
FIG. 5*b* is a side view of a typical roller guide arrangement.

A preferred form of a guide structure 64 is illustrated in FIGS. 5*a* and 5*b*. As shown in FIG. 5*a*, this guide structure 64 comprises a plurality of roller guides 66 and a guide tube 68 that orient the tows of reinforcing material to guide the moving tows from the supplies 60 to the column 20. Each roller guide 66 includes a sufficient number of rollers to guide the tow of reinforcing material 61 in the desired direction. A general form of the roller guide 66 is shown in FIG. 5*b*. The roller guide 66 includes at least one roller 66' oriented so that the reinforcing material 61 can pass over the roller 66'. In the general form of the roller guide 66 shown in FIG. 5*b*, there are four rollers 66' so that guidance is provided whatever the orientation and position of the reinforcing material 61.

An end 69 of the guide tube 68 is located close to the surface of the vertical column 20, preferably within about 2 inches of the vertical column 20. The combination of the roller guides 66 and their arrangement, and the closeness of the end 69 of the guide tube 68 to the vertical column 20, cooperate to cause the multiple tows of reinforcing material 61 to be wound in a closely adjacent fashion onto the surface of the vertical column 20. That is, in the illustrated embodiment six slightly flattened tows are simultaneously deposited onto the surface of the vertical column 20 in a side-by-side relation. The slightly flattened carbon fiber/epoxy tows that are preferred are each about 0.11 inches wide, so that the total width of the ribbon that is deposited simultaneously from the six tows is about 0.68 inches wide.

In the apparatus 30, the two pieces 34 of the base 32, the vertical mast 48, and the motor 44 are provided as separate pieces that can be readily assembled together about the vertical column 20. The objective of this modular design is to minimize the maximum weight of any one of the pieces so that transportation and assembly can be readily accomplished by a small number of persons using a light crane. A prototype of the apparatus 30 suitable for wrapping vertical columns up to 4 feet in diameter and 25 feet high had no single piece weighing more than 350 pounds. Transportation and assembly could therefore be accomplished by three persons using a light crane.

Figure 6:
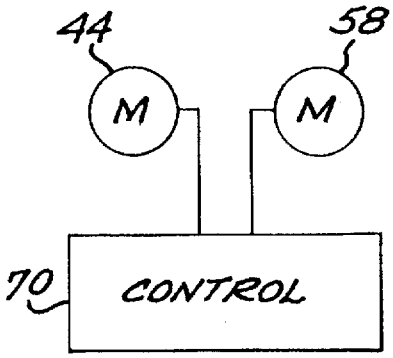
FIG. 6 is a schematic depiction of a controller used in the present approach.
Figure 7:
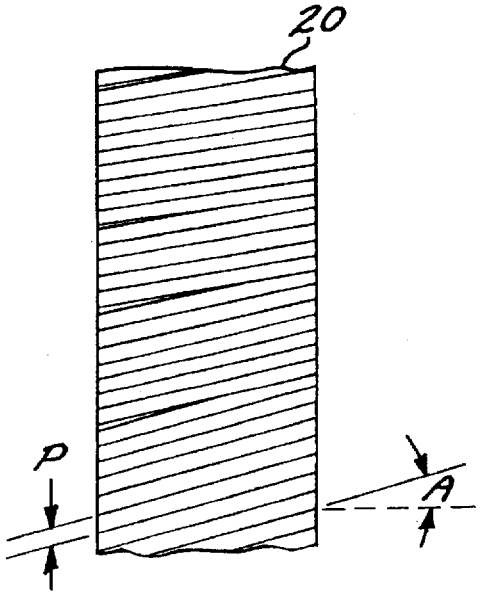
FIG. 7 is an elevational view of a region of a column wrapped with a composite material.

FIG. 6 illustrates the control system for the apparatus 30, which is not complex. The apparatus 30 produces a spirally wound reinforcement as illustrated in FIGS. 2 and 7. The principal controlled parameters of interest are the upward or downward sense of the advance of the spiral, an advance angle A of the individual turns of the spiral with respect to the horizontal plane, shown in FIG. 7, and the pitch P between the individual turns. The pitch P is the center-to-center distance between the individual turns. As noted previously, one control approach is to maintain a fixed speed ratio for the motors 44 and 58, so that the winding pitch is constant regardless of the winding speed.

The sense of the advance of the spiral (i.e., whether A is positive or negative with respect to the horizontal plane) is determined by the selection of the direction of movement of the vertical carriage 50 (up or down). FIG. 2 depicts a situation where a first layer of spirally wrapped reinforcement has been wrapped with the vertical carriage 50 moving upwardly. The vertical carriage reached the top of its travel and reversed to move downwardly. A second layer of spirally wrapped reinforcement is formed over the first layer, with the sense of advance downwardly (a negative angle A). The direction of rotation of the rotary carriage 38 could also be changed between clockwise and counterclockwise, but normally this is not done. The sense of rotation of the rotary carriage 38 is normally maintained the same throughout the entire wrapping operation for a vertical column.

The magnitude of the angle A is directly controlled through the relative vertical rate of movement of the vertical carriage 50 and the circular rate of movement of the rotary carriage 38. The faster the rate of vertical movement of the vertical carriage 50 with respect to the rotary carriage 38, the greater is the angle A. The pitch P is determined by the absolute rate of vertical movement of the vertical carriage 50 and the diameter of the vertical column 20.

The sense of the spiral, the angle A, and the pitch P can therefore all be controlled by varying the rates of movement of the vertical carriage 50 and the rotary carriage 38. These rates of movement are directly controlled by the direction of movement of the motor 58 and the speeds of the motors 44 and 58. A controller 70 can therefore be as non-complex as a reversing control for the motor 58 and a rheostat for each of the motors 44 and 58. However, if the controller 70 includes a microprocessor that controls both the direction of the motor 58 and the speeds of the motors 44 and 58, more precise control can be achieved in wrapping complex patterns. For example, FIG. 7 shows an example of a column where a large angle A has been used at the bottom of the vertical column 20, and there has been a gradual transition to a small angle A at the top of the vertical column. If the pitch P is to remain constant, this change is accomplished by varying the speed of the motor 44. A microprocessor can store various combinations of speeds in its memory, or compute them from geometrical relationships in order to achieve desired results.

In this approach, the magnitude of advance angle A is no more than about 1 degree, and most preferably no more than about 0.5 degrees, from the horizontal, either positive or negative. (Angle A is exaggerated in FIG. 7 for illustration.) That is, the reinforcing material is preferably oriented nearly as a hoop reinforcement with a low rate of advance. Higher values of angle A lead to vertical column stiffening, an undesirable result for most situations. The pitch P is made equal to the width of the ribbon of reinforcing material, about 0.90 inches in the preferred case, so that the adjacent turns are laid down in a side-by-side arrangement.

Another feature of the present approach is shown in FIG. 2. A sensor 72 can be imbedded between layers of the spirally wound reinforcing material, or between the concrete of the vertical column and the first layer. Care is taken to thread a sensor lead 74 of the sensor 72 between adjacent turns of the reinforcing material. Sensors such as optical fibers and magnetostrictive sensors can be embedded in this manner. Additionally, sensors such as strain gages or acoustic emission transducers can be placed onto the exterior surface of the top layer of the reinforcing material.

Figure 9:
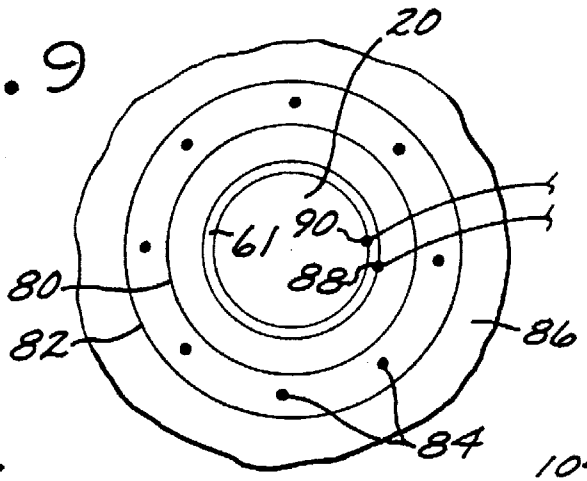
FIG. 9 is a plan view of a wrapped column with a radiant heater to cure the composite reinforcement.
Figure 8:
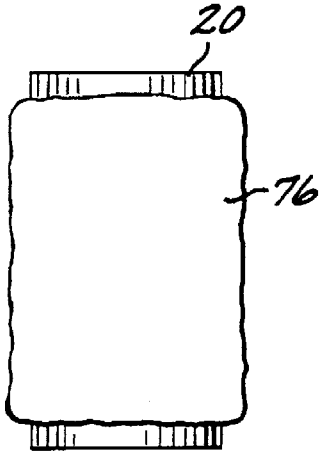
FIG. 8 is an elevational view of a wrapped column with a heating blanket and insulation in position to cure the composite reinforcement.

After the wrapping procedure is complete, the apparatus 30 is disassembled and removed from the vertical column 20. If the reinforcing material contains a curable component such as a curable epoxy matrix, the reinforcing material is heated in place on the vertical column to accomplish the curing. Any operable heating means can be used that reaches the required temperature. However, because the region to be heated is large, it is preferred to use as economical a heater as possible. FIG. 8 depicts an insulated heating blanket 76 that is wrapped overlying the vertical column 20. FIG. 9 shows another approach. Here, the vertical column 20 with its overwrap of reinforcing material 61 is surrounded by a gas heater 78. The heater 78 includes an inner conductive wall 80, an outer insulative wall 82, and a space therebetween with gas jets 84. An insulation layer 86 overlies the outer wall 82. The gas jets 84 are operated to heat the inner wall 80 and thence the reinforcement 61. FIGS. 18–21 illustrate a most preferred approach for accomplishing the curing of the reinforcing material 61 wound upon the vertical column 20. A curing apparatus 300 comprises a cylindrical housing 302, preferably made of steel such as stainless steel, which is split lengthwise (i.e., parallel to the axis of the cylinder) to form two semicylindrical sections 304*a* and 304*b*. (For large, heavy housings 302, the housing may be split lengthwise into more than two sections, each of which may be readily transported and handled.) The semicylindrical sections 304*a* and 304*b* are assembled over the perimeter of the column 20 and the reinforcing material 61, and held in place with bolts extending through flanges 306.

Figure 20:
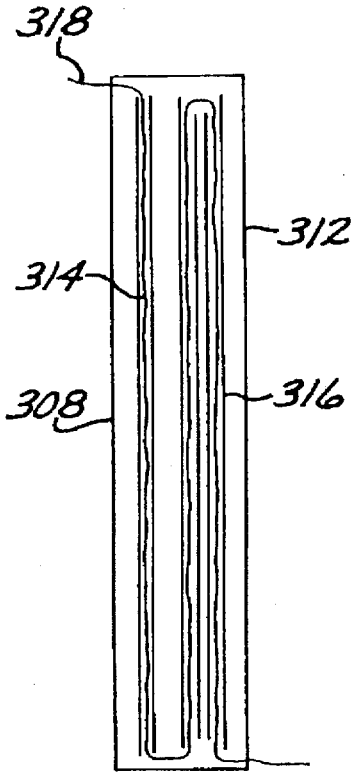
FIG. 20 is an elevational view of one of the radiant heating elements used in the apparatus of FIGS. 18 and 19, taken along line 20—20 of FIG. 19.

At least two, and preferably a plurality of, elongated radiant heating panels 308 are mounted to an interior wall 310 of the housing 302 with their directions of elongation extending parallel to the axis of the cylindrical housing. The radiant heating panels 308 are oriented to direct the heat produced inwardly toward the column 20. As shown in FIG. 20, each elongated heating panel 308 has a ceramic body 312 with an electrical-resistance heating element 314 received into recesses 316 in the ceramic body 312 that extend parallel to the direction of elongation of the heating panel 308. The heating elements 314 are preferably metallic wires made of a high-resistance material such as Inconel. Copper electrical leads 318 extend from the heating elements 314. Self-contained heating panels of this type are available commercially from manufacturers such as Omega Engineering, Stamford, Conn. The leads 318 extend to a power supply 319. The leads to the separate heating panels 308 may be connected in series or parallel, or to separate power supplies, as necessary to achieve the heating intensities required.

The radiant heating panels 308 are spaced-apart around the circumference of the interior wall 310 of the housing 302. Heat reflector surfaces 320 are provided in the intermediate regions of the interior wall 310 between the individual panels 308. The heat reflector surfaces 320 are preferably polished surfaces of the interior wall 310, which is preferably made of stainless steel so that the polish will be retained even after multiple heatings. The polish need not be to a high gloss, but sufficient to reflect heat produced by the radiant heating panels 308 and the heat radiated by the reinforcing material 61. The objective of the heat reflector surfaces 320 is to even the spatial distribution of heating energy in the reinforcing material 61 so as to achieve an even cure.

The cylindrical housing 302 may be made as long as required for the length of the column 20. However, it is desirable to make the cylindrical housing 302 in relatively short modular lengths of about 8 feet, thereby effectively sectioning the housing transversely to the cylindrical axis. Multiple housings are placed in an end-to-end relationship, as shown by the modules 322*a* and 322*b*, to form a length sufficient for long columns without having to build a custom curing apparatus for each different length of column encountered. Each module 322*a*, 322*b* may have its own power supply 319, or in some instances the same power supply may be used for all of the modules.

Figure 21:
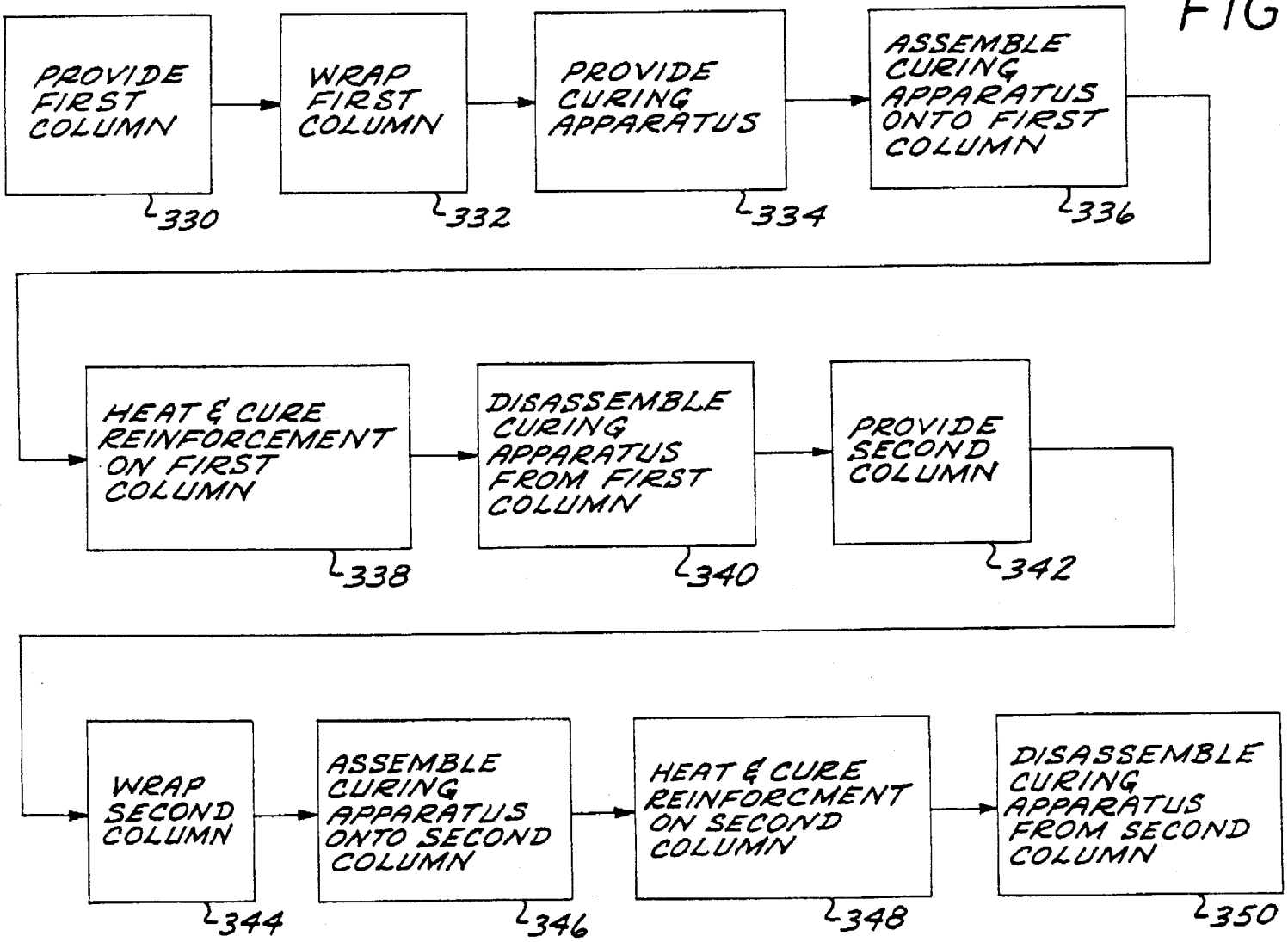
FIG. 21 is a block flow diagram of use of the apparatus of FIG. 18 for curing vertical columns.

FIG. 21 illustrates the steps of a method for utilizing the curing apparatus to cure the reinforcement on columns. A first column is provided, numeral 330, and the reinforcing material having a heat-curable matrix is applied by any operable technique, numeral 332, most preferably one of the techniques described herein. The curing apparatus is provided, numeral 334, and assembled over the perimeter of the first column, numeral 336. The curing apparatus and its heating elements are operated to provide the temperature and time profile for proper curing, as specified by the manufacturer of the curable polymeric matrix material, numeral 338. After curing is complete, the apparatus is disassembled from the first column, numeral 340. The first column is complete.

Figure 18:
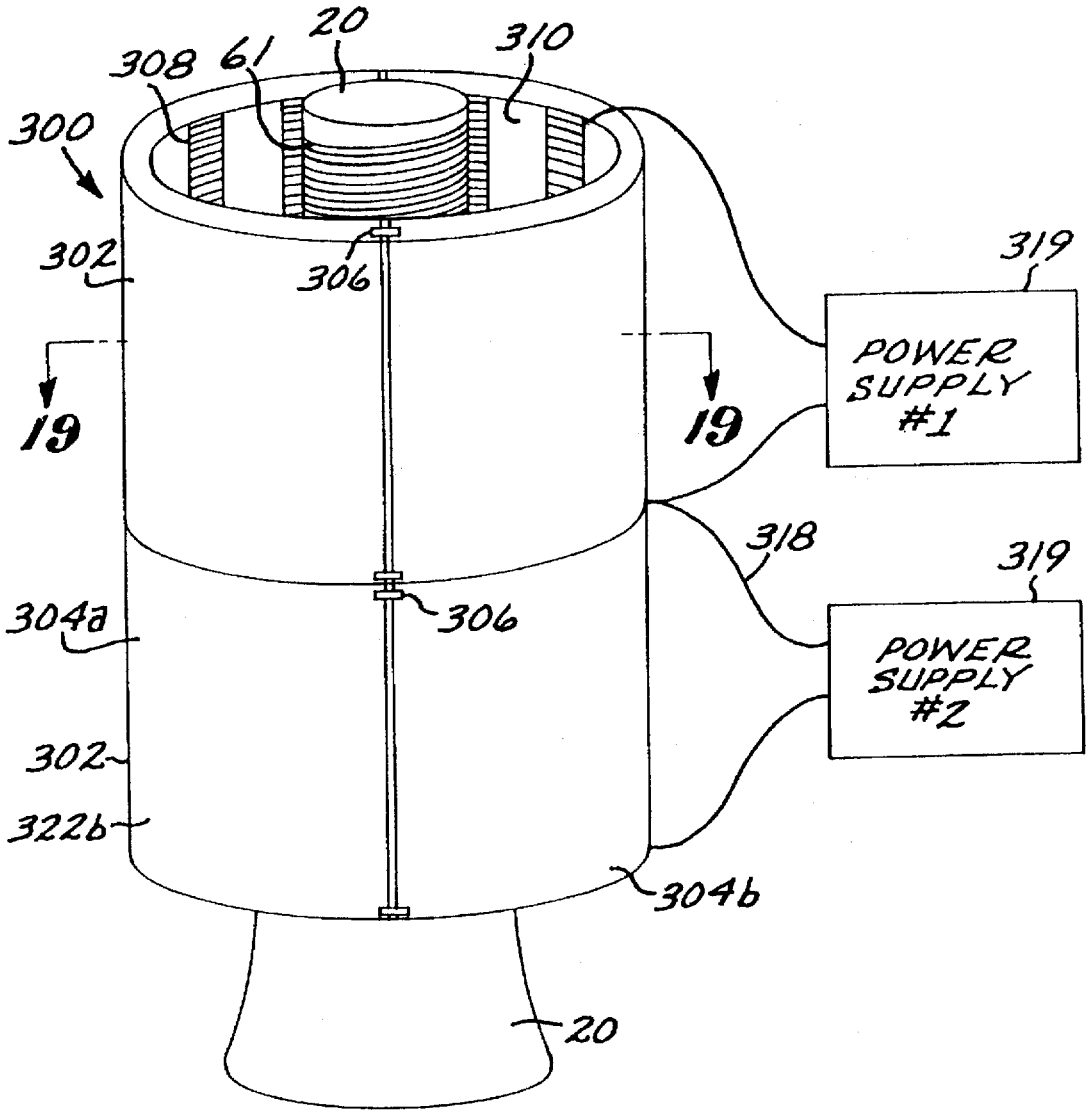
FIG. 18 is a perspective view of a radiant heat curing apparatus assembled on a vertical column.
Figure 19:
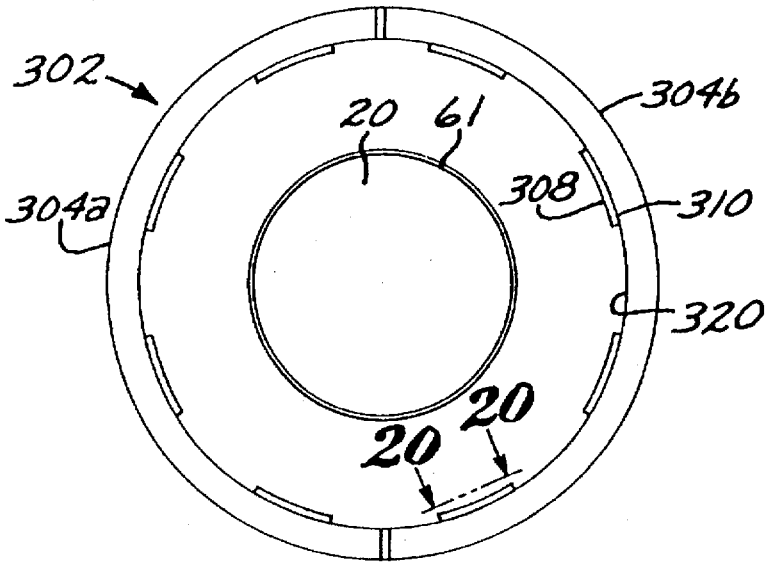
FIG. 19 is a schematic sectional view of the apparatus and column of FIG. 18, taken along line 19—19 of FIG. 18.

A second column is provided, numeral 342, and the reinforcing material is applied, numeral 344. The curing apparatus is assembled onto the second column, numeral 346. The curing apparatus for the second column is, in most cases, the same curing apparatus as used for the first column, even though the columns are of different effective diameters. As used herein, the "effective" diameter is the largest lateral dimension of the column that must be accommodated within the housing 302. For example, the effective diameter of a cylindrical column is its cylindrical diameter, and the effective diameter of a polygonal column is its largest vertex-to-vertex dimension. The effective diameter of a column may vary along its length, typically being larger near the bottom and smaller near the top, as shown in FIG. 18. An important advantage of the present curing approach is that the inner diameter of the housing 302 is made larger than the largest column effective diameter that is expected to be encountered, so that the housing 302 can accommodate both small and large effective column diameters, as may be found on different columns and at different positions on the same column. If the second column is of different length than the first column, it may be necessary to add or remove curing apparatus modules. The curing apparatus therefore need not be custom for each effective diameter of column, and all that is required is a sufficient number of modules for the longest columns that might be encountered.

The reinforcement is heated and cured, numeral 348, by heating the heating elements of the curing apparatus, as described previously. For different effective column diameters or different polymeric matrices, different heating schedules may be required. When curing is complete, the curing apparatus is disassembled from the second column, numeral 350, and used elsewhere.

In the approaches of FIGS. 8, 9, or 18–20, the temperature at the surface of the reinforcing fiber and the temperature at the surface of the vertical column may be measured with thermocouples 88 and 90, respectively. Additional thermocouples are provided as desired. The thermocouples provide a feedback of temperature information so that the heater temperature and time can be adjusted to achieve a proper curing cycle of the reinforcing material.

Figure 10:
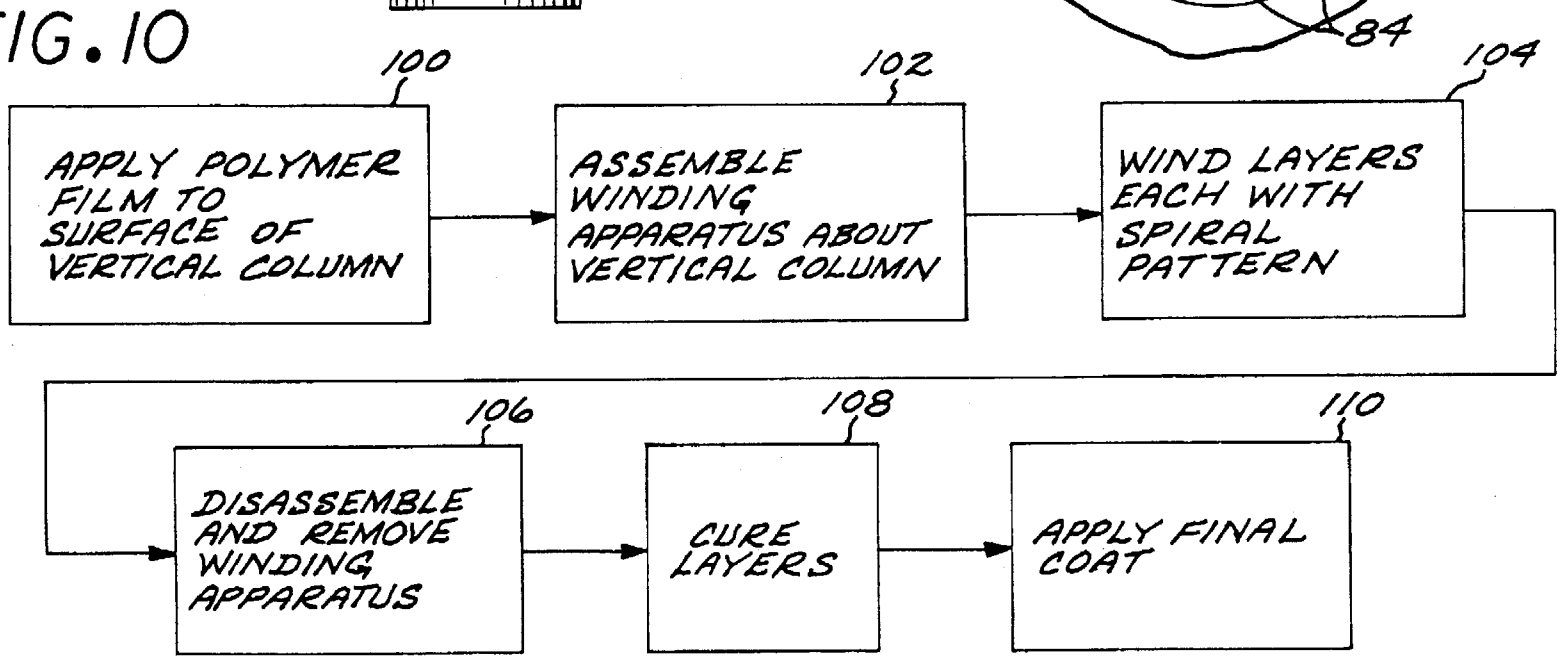
FIG. 10 is a block flow diagram for the method of the invention.
Figure 11:
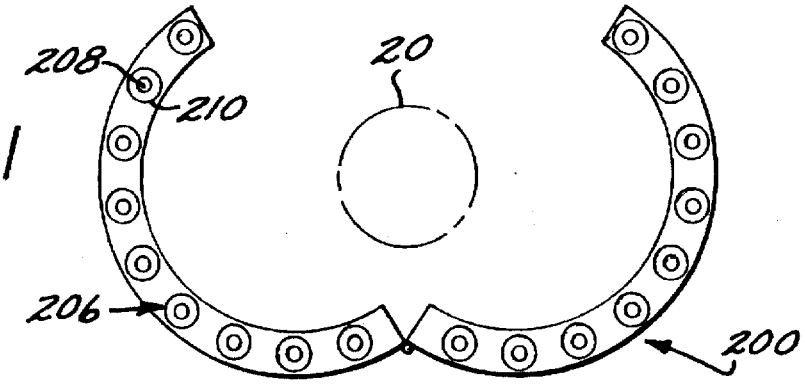
FIG. 11 is a plan view of a base used in a second embodiment of the invention, in the open position permitting assembly to a vertical column.
Figure 12:
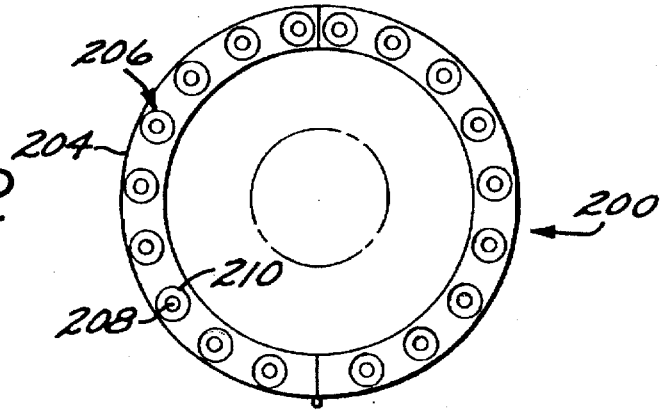
FIG. 12 is a plan view of the base of FIG. 11, after assembly to the vertical column.

FIG. 10 shows in block diagram form the preferred approach for reinforcing the external surface of the vertical column 20. The external surface of the column is first prepared for wrapping, numeral 100, as necessary. In a typical preparation for retrofitting an existing vertical column that has been exposed for a number of years, the column is first cleaned, patched with a filler material, or otherwise repaired as to any surface defects or problems that might interfere with the wrapping operation. The external surface is covered with a polymer film, numeral 100, which acts much like a primer. The polymer film is preferred because it seals the reinforcement against water vapor emitted from the concrete of the column when the concrete heats, and also from dust and dirt. The polymer film is painted onto the surface of the vertical column 20 prior to assembly of the apparatus 30 and allowed to dry according to the instructions for the product. In the most preferred case, the polymer film is formed by painting onto the external surface a sufficient amount of liquid two-component curable urethane polymer to form a thickness of about 0.10 inches upon drying. Drying requires a time of about 1 hour.

The apparatus 30 is assembled around the vertical column 20, numeral 102. The spirally wound layers of reinforcing material are wrapped in the manner previously discussed, numeral 104. Sensors are wrapped into place as desired. When the required number of layers have been completed, the apparatus is disassembled and removed, numeral 106. The heating means is assembled over the uncured reinforcement material, and the layers are heated to cure the curable component according to the manufacturer's specifications for the curing, numeral 108. In a typical case, the curing is accomplished by heating to a temperature of about 180°–400° F. over a period of about 1 hour, soaking at that temperature for about 1 ½ to 3 hours, and then allowing the reinforcing material to cool with the heating means in place. The thermocouples are used to assess the heating of the reinforcing material. After the heating and curing is complete, it is desirable to apply a finish coat over the top layer of the reinforcing material to seal and protect the reinforcing material. The preferred finish coat is a two-component urethane polymer available as Ultracoat 2000 finish polymer, which is applied by painting a layer and permitting it to dry at ambient temperature.

A prototype apparatus 30 has been constructed and used to wrap a number of vertical columns. Seven 0.4 scale vertical columns, each 8–12 feet tall and made of steel-reinforced concrete, were wrapped with carbon-prepreg tows. Five full-size columns, each 25–30 feet tall and 4 feet in diameter, were wrapped with carbon-prepreg tows. The carbon composite jacket was cured in-situ on the columns. Some of the retrofitted columns were tested to failure under simulated seismic loads. The tests showed with predictable structural performance that appropriately designed and installed carbon jackets can provide the same or a better level of seismic protection as conventional steel jackets, with significant improvement in terms of speed of application and quality control, due to the fully automated installation process.

Because the vertical column 20 is ordinarily quite large, it is desirable to increase the speed of the winding process as much as possible. An apparatus 200 for achieving increased winding speeds is illustrated in FIGS. 11–14. The apparatus 200 utilizes many of the same features and components as the apparatus 30, and the description of the apparatus 30 is incorporated to the extent applicable. The following discussion will focus on the different aspects of the apparatus 200.

Figure 13:
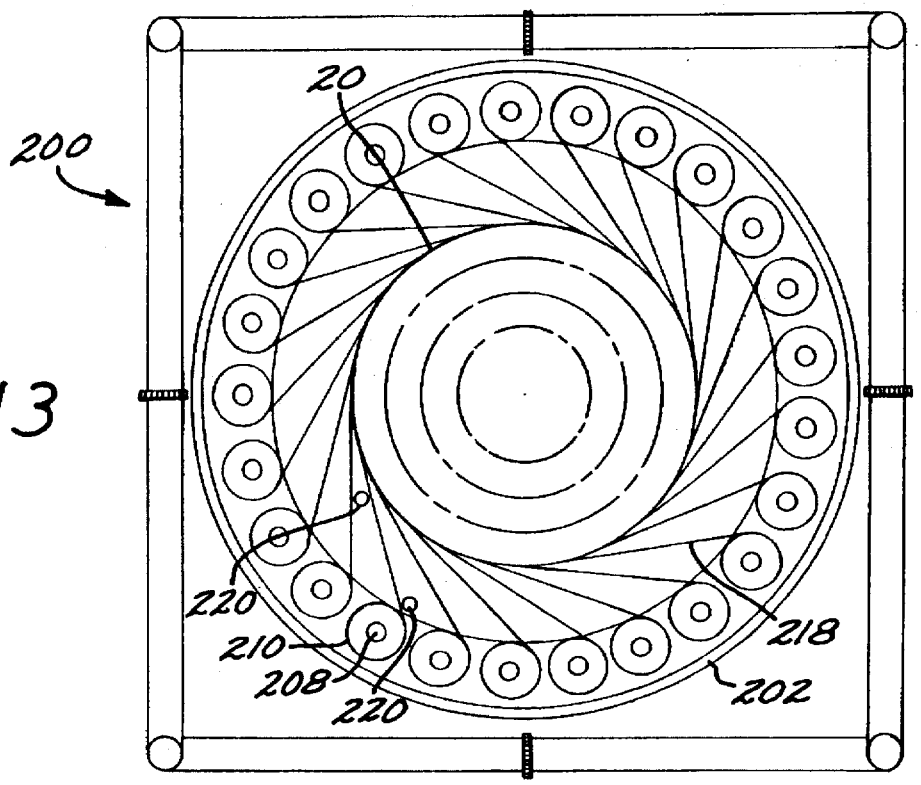
FIG. 13 is a plan view of the base of FIG. 12, in operation to wind the vertical column.

The apparatus 200 includes a base 202. The base is preferably formed of two semicircular sections that are hinged together for easy positioning over the column 20 (FIG. 11), assembly together by closing about the column 20 (FIG. 12), and later disassembly after the wrapping is complete. The base 202 supports a rotary carriage 204 that can rotate circumferentially on the base 202, as seen in FIG. 13. A supply 206 of a reinforcing material is supported on the rotary carriage 204. Preferably, the supply 206 includes a plurality of creels 208 extending vertically upwardly from the rotary carriage 204 and a plurality of bobbins 210 of reinforcing material supported on the creels, one bobbin on each creel. There are preferably at least 12, and desirably more, creels and bobbins, arranged so that the reinforcement dispensed from each bobbin is laid down in a side-by-side arrangement. For a selected width of reinforcement material, the more bobbins, the faster the reinforcement can be wound onto the column. According to one analysis using realistic engineering analyses and structural values, the wrapping of a large column can be completed by the apparatus 200 in about 1/25 of the time required by the apparatus 30.

A first drive system 212 drives the rotary carriage 204 in the circumferential direction on the base 202. The first drive system 212 is generally similar to that of the apparatus 30, including a variable-speed motor 214 and a linkage such as a chain 216 or belt (or gears) to the rotary carriage 204.

As seen in FIG. 13, the reinforcement 218 is guided from the bobbins to the column 20 by roller guides 220, only one set of which are shown in FIG. 13. The apparatus 200 with the indicated placement of the creels 208 and bobbins 210 requires only two roller guides 220 per creel and bobbin, while a larger number is required for each bobbin of the apparatus 30. The reduction in the number of roller guides reduces the potential for damage to the reinforcement and reduces the maintenance of the apparatus 200.

Figure 14:
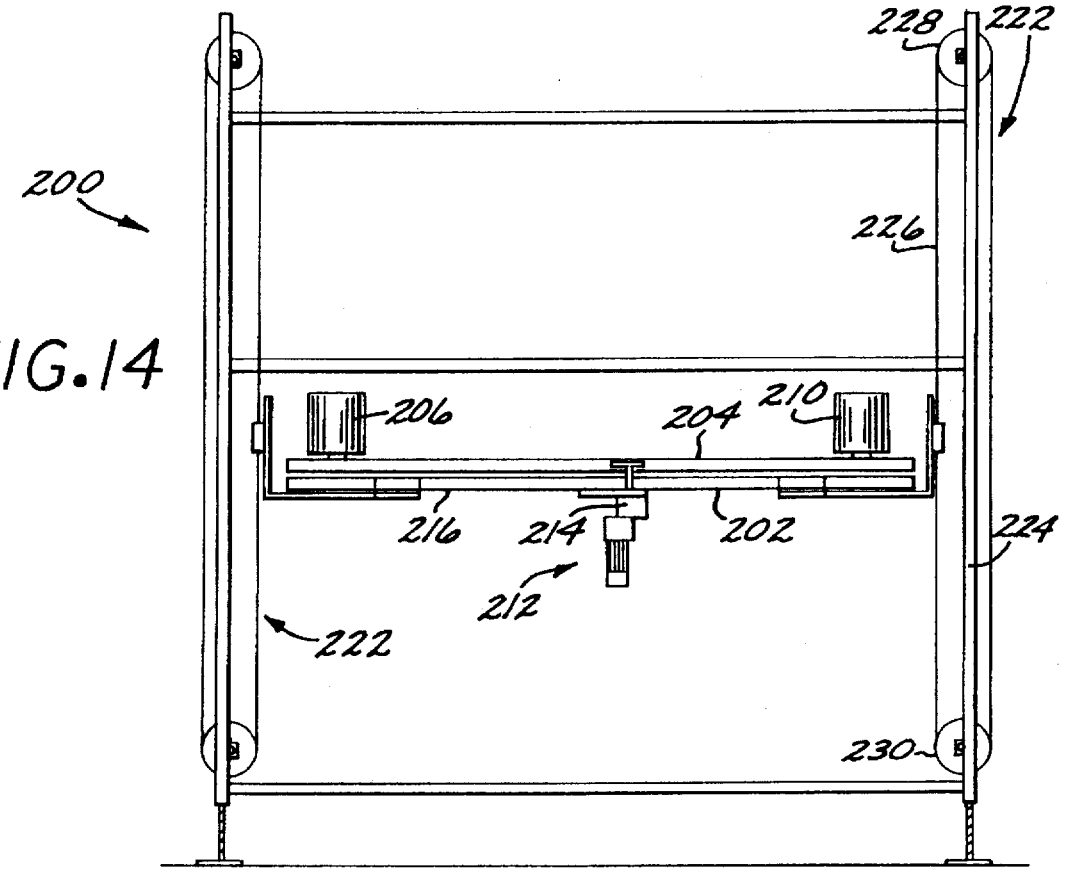
FIG. 14 is an elevational view of one version of the vertical drive system.
Figure 15:
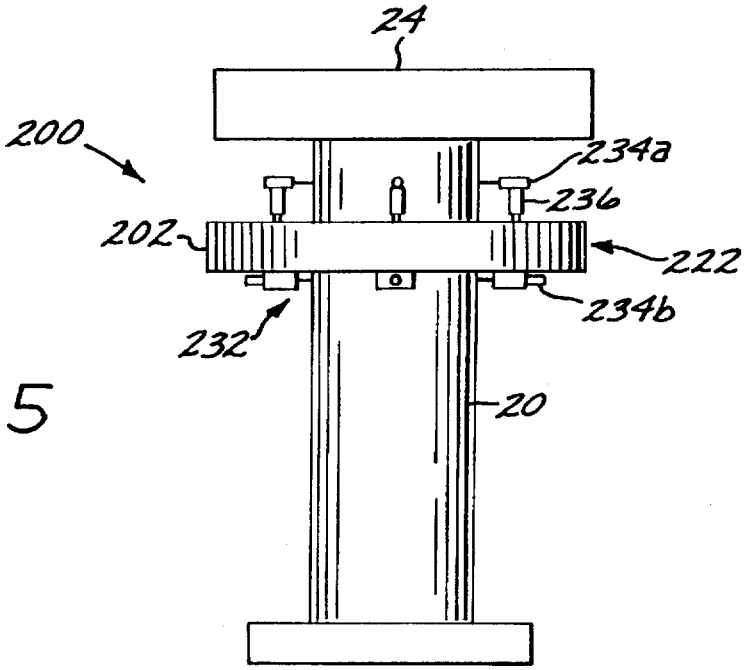
FIG. 15 is an elevational view of a second version of the vertical drive system.
Figure 16:
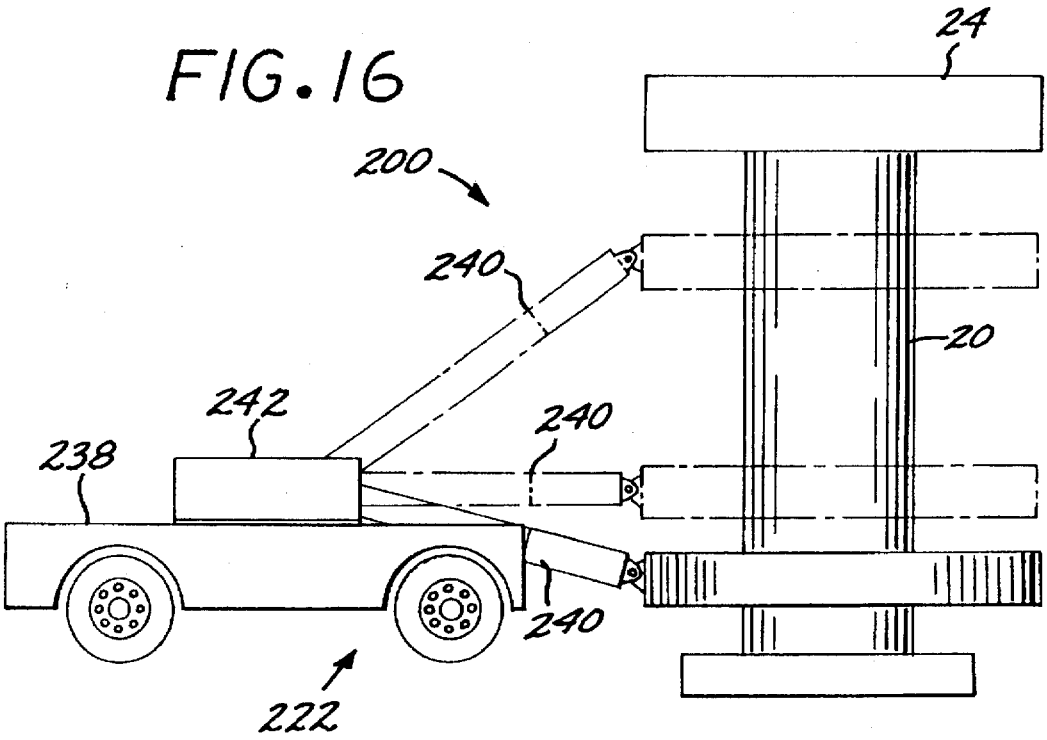
FIG. 16 is an elevational view of a third version of the vertical drive system.

The base 202 is moved vertically along the column 20 by a second drive system 222. Moving the entire base 202, with the bobbins 210 supported thereon, results in a relatively short, unvarying distance between the bobbins 210 and the column 20. FIGS. 14–16 illustrate three forms of the second drive system 222, and any other operable second drive system can be used as well.

In FIG. 14, a four-post scaffold 224 is erected around the column 20. The total height of these commercially available scaffold systems is easily varied by adding modular sections in an erector-set manner. A chain or belt drive 226 extends between a top pulley 228 and a bottom pulley 230 of each of the posts of the scaffold 224, and the distance between the pulleys 228 and 230 can be increased by adding modular sections to the posts. The base 202 is attached to the four chain drives 226, and is raised and lowered by the action of a vertical drive motor (not shown).

FIG. 15 illustrates a self-contained climbing mechanism 232 that is supported on the vertical column 20, so that no connection with the ground is required. This mechanism 232 is particularly useful where the ground is uneven or the foot of the vertical column is underwater, as in the case of a piling, and in space-restricted areas such as in buildings and parking structures. The mechanism 232 includes two independent sets of pneumatic, electric, or hydraulic pistons 234. One set includes four pistons **234*a* that face inwardly toward the column 20. The other set includes four pistons 234*b* that face inwardly toward the column 20, and four pistons 236 that connect between the support structure of the pistons 234*a* and the base 202. Movement is accomplished by forcing the pistons of one of the sets of pistons 234, say the pistons 234*a* against the column 20, and then retracting the pistons 234*b*. The vertical pistons 236 are retracted together in a coordinated fashion to raise the base 202. When the fully retracted position of the pistons 236 is reached, the pistons 234b are clamped against the column, the pistons 234a are retracted, and the pistons 236 are extended to move the pistons 234a upwardly. The pistons 234a are forced against the column 20**, and the process repeats.

A mobile lift 238 is used in the embodiment of the second drive system 22 of FIG. 16. The base 202 is supported by a boom 240 mounted to a turret 242 of the mobile lift 238. Coordinated movements of the boom 240 and the turret 242 permit the base 202 to be moved upwardly and downwardly while retaining its horizontal orientation, as depicted by the several superimposed illustrations of FIG. 16. This approach has the advantage of allowing a very fast erection of the apparatus 200 at locations where there is good vehicle access to the bottom of the column 20.

The movements of the first drive system 212 and the second drive system 222 are coordinated and controlled by a computer control system like that illustrated and discussed in relation to FIG. 6. The computer can control any of the types of motors and drives discussed herein, and produce various wrapping angles and densities as discussed previously.

Figure 17:
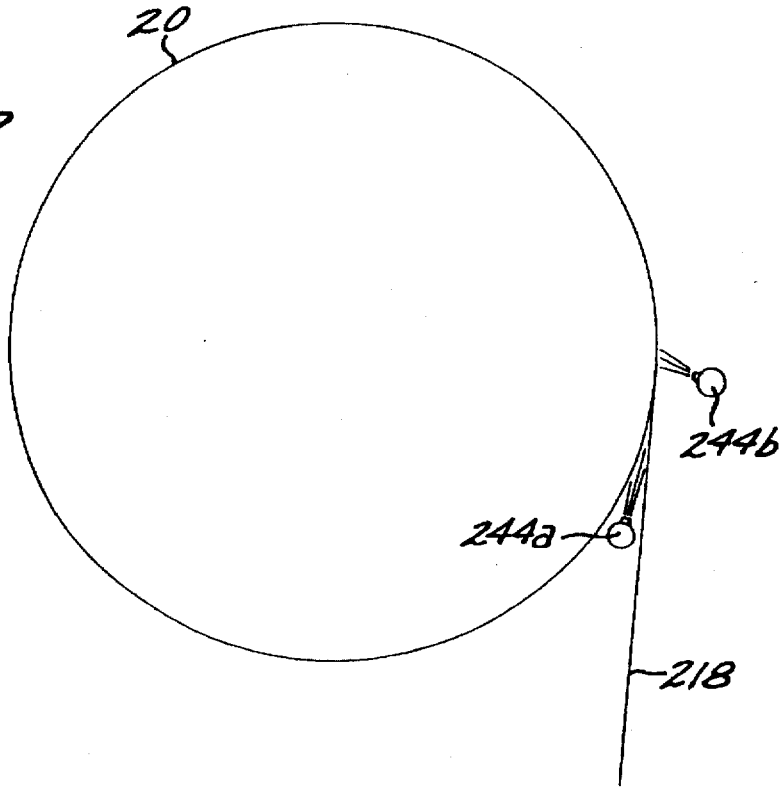
FIG. 17 is a schematic plan view of a column being wrapped with a dry reinforcing fiber to which a polymeric material is added during winding.

To this point, the reinforcement 218 has been described as a prepreg composite material that is cured after wrapping. That approach is useful with the apparatus 30 and the apparatus 200. Alternatively, the reinforcement wrapped around the column 20 can be "dry" fiber which is not furnished embedded in curable polymeric material. The dry fiber is typically furnished in bundles or tows of fibers. The dry fiber is wrapped around the column using the apparatus 30 or apparatus 200. After wrapping is complete, a curable polymeric resin or a non-organic coating can be added to the upper surface of the dry fiber wrap and cured or dried in place. In a variation of the use of dry fiber illustrated in FIG. 17, the curable polymeric material is supplied at the point where the reinforcement 218 contacts to the column 20. The curable polymeric material, which typically has a viscosity like that of a syrup, is supplied by nozzles 244 positioned closely to the point where the reinforcement contacts the column. In FIG. 17, the nozzle 244a directs liquid polymer into the bite of the acute angle between the reinforcement and the column, and the nozzle 244b directs liquid polymer onto the top surface of the as-deposited reinforcement fiber. The polymer is thereafter cured in the manner discussed previously.

The preferred embodiments of the invention have been described in terms of a retrofit to an existing column, but it has equal applicability to the initial fabrication of the column.

What is claimed is:

1. A method for preparing a reinforced column, comprising the steps of:

providing a vertically extending column having a column effective diameter;

positioning a reinforcement to contact a perimeter of the column, the reinforcement comprising elongated fibers in a curable matrix;

providing a reinforcement curing apparatus comprising a steel cylindrical housing split lengthwise into at least two sections, and a plurality of elongated radiant heaters mounted to an interior wall of the housing and oriented to direct their heat inwardly;

assembling the curing apparatus around the perimeter of the column having the reinforcement thereon; and operating the radiant heaters to heat and cure the reinforcement.

2. The method of claim 1, wherein the method includes the additional steps of providing a vertically extending second column having a second column effective diameter;

positioning a second reinforcement to contact a perimeter of the second column, the second reinforcement comprising elongated fibers in a curable matrix;

assembling the curing apparatus around the perimeter of the second column having the second reinforcement thereon; and operating the radiant heaters to heat and cure the second reinforcement.

3. The method of claim 1, wherein the step of providing a reinforcement curing apparatus includes the step of providing the curing apparatus wherein the plurality of elongated radiant heaters are circumferentially spaced apart around a circumference of the interior wall of the housing.

4. The method of claim 1, wherein the step of providing a reinforcement curing apparatus includes the step of providing the curing apparatus wherein the plurality of elongated radiant heaters are circumferentially spaced apart around the circumference of the interior wall of the housing, and wherein the space between the radiant heaters has a heat reflective surface.

5. The method of claim 1, wherein the step of providing a reinforcement curing apparatus includes the step of providing a power supply operatively connected to the radiant heaters.

6. The method of claim 1, wherein the step of providing a reinforcement curing apparatus includes the step of providing the plurality of radiant heaters having electrically resistive heating elements.

7. The method of claim 1, wherein the step of providing a reinforcement curing apparatus includes the step of providing the curing apparatus wherein the cylindrical housing comprises at least two split cylindrical sections each sectioned transversely into at least two modules, with the modules disposed in an end-to-end relation.

8. The method of claim 1, wherein the steel housing comprises stainless steel.

9. A method for preparing a reinforced column, comprising the steps of:

providing a vertically extending column having a column effective diameter;

positioning a reinforcement to contact a perimeter of the column, the reinforcement comprising elongated fibers in a curable matrix;

providing a reinforcement curing apparatus comprising a cylindrical housing, and a plurality of elongated radiant heaters mounted to an interior wall of the housing and oriented to direct their heat inwardly;

assembling the curing apparatus around the perimeter of the column having the reinforcement thereon; and operating the radiant heaters to heat and cure the reinforcement.

10. The method of claim 9, wherein the method includes the additional steps of providing a vertically extending second column having a second column effective diameter;

positioning a second reinforcement to contact a perimeter of the second column, the second reinforcement comprising elongated fibers in a curable matrix;

assembling the curing apparatus around the perimeter of the second column having the second reinforcement thereon; and operating the radiant heaters to heat and cure the second reinforcement.

11. The method of claim 9, wherein the step of providing a reinforcement curing apparatus includes the step of providing the curing apparatus wherein the plurality of elongated radiant heaters are circumferentially spaced apart around a circumference of the interior wall of the housing.

12. The method of claim 9, wherein the step of providing a reinforcement curing apparatus includes the step of providing the curing apparatus wherein the plurality of elongated radiant heaters are circumferentially spaced apart around the circumference of the interior wall of the housing, and wherein the space between the radiant heaters has a heat reflective surface.

13. The method of claim 9, wherein the step of providing a reinforcement curing apparatus includes the step of providing a power supply operatively connected to the radiant heaters.

14. The method of claim 9, wherein the step of providing a reinforcement curing apparatus includes the step of providing the plurality of radiant heaters having electrically resistive heating elements.

15. The method of claim 9, wherein the step of providing a reinforcement curing apparatus includes the step of providing the curing apparatus wherein the cylindrical housing comprises at least two split cylindrical sections each sectioned transversely into at least two modules, with the modules disposed in an end-to-end relation.

* * * * *